US009114969B2

(12) United States Patent
Huitorel et al.

(10) Patent No.: US 9,114,969 B2
(45) Date of Patent: Aug. 25, 2015

(54) FILLING DEVICE HAVING A FLOW REGULATION SYSTEM

(75) Inventors: Mickael Huitorel, Octeville sur Mer (FR); Arnaud Pasquet, Octeville sur Mer (FR); Didier Cadiou, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 86 days.

(21) Appl. No.: 13/808,930

(22) PCT Filed: May 12, 2011

(86) PCT No.: PCT/EP2011/057733
§ 371 (c)(1),
(2), (4) Date: Jan. 8, 2013

(87) PCT Pub. No.: WO2012/004034
PCT Pub. Date: Jan. 12, 2012

(65) Prior Publication Data

US 2013/0112719 A1 May 9, 2013

(30) Foreign Application Priority Data

Jul. 8, 2010 (FR) ..... 10 55583

(51) Int. Cl.
*B67C 3/28* (2006.01)

(52) U.S. Cl.
CPC .. *B67C 3/28* (2013.01); *B67C 3/286* (2013.01)

(58) Field of Classification Search
CPC ..... B67C 3/26; B67C 3/28; B67C 3/206; B67C 3/286; B67C 3/204; B67C 3/2608; B67C 3/281; B05C 5/0225; B05C 5/0291; B65B 39/004; B65B 39/002; B65B 31/044; G01F 11/32
USPC ..... 141/146, 128; 222/14, 20, 17, 21, 59, 222/282–284, 305, 306, 450, 451, 453, 559, 222/545, 267, 275, 484, 482, 481, 544, 537
See application file for complete search history.

(56) References Cited

U.S. PATENT DOCUMENTS

| | | | | | |
|---|---|---|---|---|---|
| 1,887,400 | A | * | 11/1932 | Dayton | 73/254 |
| 2,319,075 | A | * | 5/1943 | McKinnis | 141/70 |
| 2,361,641 | A | * | 10/1944 | McKinnis | 141/70 |
| 3,797,535 | A | * | 3/1974 | Kaiser | 141/46 |

(Continued)

FOREIGN PATENT DOCUMENTS

| | | | |
|---|---|---|---|
| DE | 3937630 | A1 | 6/1990 |
| GB | 891108 | A | 3/1962 |

(Continued)

*Primary Examiner* — Paul R Durand
*Assistant Examiner* — Randall Gruby
(74) *Attorney, Agent, or Firm* — Bachman & LaPointe, P.C.

(57) ABSTRACT

A filling device for a machine for filling containers, includes a spout having an outlet orifice and a feed orifice, and a feed duct connected to the feed orifice. A first actuating system is able to move a valve, which is mounted in the spout, between a closed position for closing the outlet orifice and at least one open position. A flow-regulating rod is mounted in a sliding manner in a hole in the feed duct and is able to be moved by a second actuating system between a high flow-rate position, in which the rod is located substantially outside the internal passage in the feed duct, and a low flow-rate position, in which the rod extends into the internal passage in order to reduce the passage cross section of the feed duct.

13 Claims, 7 Drawing Sheets

(56) References Cited

U.S. PATENT DOCUMENTS

| | | | | | |
|---|---|---|---|---|---|
| 3,862,708 | A | * | 1/1975 | Waxlax | 222/444 |
| 3,918,475 | A | * | 11/1975 | Trusselle | 141/128 |
| 4,047,547 | A | * | 9/1977 | Rechtsteiner et al. | 73/863.86 |
| 4,492,259 | A | * | 1/1985 | Sick et al. | 141/198 |
| 4,548,020 | A | * | 10/1985 | Rozmus et al. | 53/268 |
| 4,801,051 | A | * | 1/1989 | Lewis et al. | 222/309 |
| 4,842,162 | A | * | 6/1989 | Merkel | 222/1 |
| 4,852,773 | A | * | 8/1989 | Standlick et al. | 222/504 |
| 4,925,069 | A | * | 5/1990 | Ueda et al. | 222/500 |
| 4,982,770 | A | * | 1/1991 | Saijo et al. | 141/258 |
| 5,027,983 | A | * | 7/1991 | Wakabayashi et al. | 222/309 |
| 5,137,187 | A | * | 8/1992 | Nichols et al. | 222/504 |
| 5,309,955 | A | * | 5/1994 | Torterotot | 141/1 |
| 5,417,260 | A | * | 5/1995 | Perrier | 141/146 |
| 5,584,324 | A | * | 12/1996 | Franke et al. | 141/1 |
| 5,758,698 | A | * | 6/1998 | Kaneko | 141/263 |
| 5,785,246 | A | * | 7/1998 | King et al. | 239/11 |
| 5,865,225 | A | * | 2/1999 | Weiss | 141/198 |
| 5,896,900 | A | * | 4/1999 | Haring et al. | 141/196 |
| 5,957,343 | A | * | 9/1999 | Cavallaro | 222/504 |
| 6,484,762 | B2 | * | 11/2002 | Fehland et al. | 141/86 |
| 6,637,625 | B1 | * | 10/2003 | Jefferson | 222/275 |
| 6,817,386 | B2 | * | 11/2004 | Tsukano et al. | 141/57 |
| 7,249,696 | B2 | * | 7/2007 | Penalver Garcia | 222/504 |
| 7,661,651 | B2 | * | 2/2010 | Kronholm | 251/124 |
| 7,703,484 | B2 | * | 4/2010 | Montavoci et al. | 141/196 |
| 7,963,305 | B2 | * | 6/2011 | Lupi et al. | 141/258 |
| 2009/0236007 | A1 | * | 9/2009 | Clusserath et al. | 141/9 |
| 2009/0293985 | A1 | * | 12/2009 | Till et al. | 141/1 |

FOREIGN PATENT DOCUMENTS

| | | | | |
|---|---|---|---|---|
| JP | 2002337988 | A | | 11/2002 |
| JP | 2006168777 | A | | 6/2006 |
| WO | 2007/137727 | | * | 12/2007 |

* cited by examiner

FILLING DEVICE HAVING A FLOW REGULATION SYSTEM

BACKGROUND

This invention relates to a filling device for a machine for filling containers with a filling product, in particular a food product, as well as a corresponding machine for filling. This invention relates more particularly to a filling device provided with a flow regulation system for the filling of containers, such as bottles or jars, with any sort of products, liquid to viscous, in particular with products that tend to foam and/or products that contain particles and/or pieces.

Machines for filling are known, in particular of the rotary type, comprising a rotating carrousel with a support structure carrying a tank of filling product and a plurality of filling devices. Each filling device conventionally comprises a filling spout, or dosing spout, a feed duct connecting the tank to the filling spout in order to feed the filling spout with filling product, and dosing means in order to deliver a determined quantity of filling product into each container brought under the filling spout. The filling spout is conventionally formed by a tubular body having an internal passage with longitudinal axis, an open lower axial end constituting the outlet orifice of the spout, and a feed orifice connected to the tank by the feed duct. The dosing means include a blocking system comprising a valve mounted mobile in said tubular body, and a valve actuating system for the longitudinal movement of said valve between a closed position in order to close the outlet orifice and an open position. The valve actuating system conventionally comprises a cylinder of which the rod passes through an open upper end of the tubular body of the spout, with the valve being fixed to the cylinder rod.

For the dosing of the product, it may be necessary to carry out the end of dosing at a low flow-rate, and this for multiple reasons: dosing precision, low free volume in the neck, foaming product, etc. For foaming products, milk in particular, it is necessary to carry out the start of dosing at a low flow-rate in order to limit the formation of foam. For semi-liquid products, this low flow-rate function can be created, without disturbing the flow, by retaining a cylindrical stream, by adjusting the position of the valve in order to reduce the opening of the dosing spout.

For liquid products, this solution cannot be applied, as the stream at the output of the dosing spout is at an accelerated speed, it has a direction that is instable, deformed and turbulent, which causes splashes and favours the formation of foam.

In order to stabilise the stream, several stacked grilles are conventionally added on the outlet orifice.

These grilles are prohibited for reasons of hygiene in the case of sensitive products such as milk where they cannot be correctly cleaned in place, and cannot be used in the case of products with particles and/or pieces. Another solution consists in providing a second seat in the filling spout cooperating with a tapered portion of the rod connected to the valve in order to limit the flow rate upstream of the valve. This solution is satisfactory but cannot be used in the case of products with pieces.

SUMMARY OF THE INVENTION

The purpose of this invention is to propose a solution aiming to overcome at least one of the aforementioned disadvantages, which is simple in design and implementation.

To this effect, this invention has for object a filling device for a machine for filling comprising

- a filling spout formed by a tubular body having an internal passage with longitudinal axis, an open lower axial end constituting the outlet orifice, and a feed orifice, lateral or axial in the upper portion, for its supply with filling product,
- dosing means comprising a blocking system comprising a valve able to be mounted mobile in said tubular body, and a first actuating system able to move longitudinally said valve between a closed position in order to close the outlet orifice and at least one open position,
- a feed duct in order to feed said filling spout with filling product, connected by a first end to the feed orifice, upstream of the blocking system, and intended to be connected by its second end to dispensing means, characterised in that said dosing means further include a flow regulation system mounted on the feed duct, said flow regulation system comprising
- a flow-regulating rod, mounted in a sliding manner, in a substantially sealed manner, in a hole of said feed duct, and
- a second actuating system able to move the flow-regulating rod, between a retracted position, referred to as high flow-rate, wherein said rod is arranged substantially outside the internal passage of the feed duct, with the passage cross section of the feed duct being at a maximum, and a deployed position, referred to as low flow-rate, wherein said rod extends into said internal passage in order to reduce the passage cross section of the feed duct.

According to the invention, the filling device comprises a flow regulation system, arranged upstream of the filling spout, formed by a simple rod that is introduced into the feed duct, in order to reduce the passage cross section of the feed duct. The rod extends directly into said internal passage in order to reduce the passage cross section of the feed duct, with the rod being directly in contact with the filling product flowing into the feed duct. This restriction of the passage makes it possible to reduce the flow rate of the product arriving at the spout. This restriction of the passage creates turbulences in the flow. By implanting the flow regulation upstream of the spout, the flow has the time to stabilise into a more laminar flow, before the outlet of the spout. The regulation system, formed by a simple rod, is simple in design and implementation. It is furthermore of low encumbrance, and can be implanted on the feed duct in different configurations, in particular horizontally or vertically. In the high flow-rate position, the passage cross section is complete, which allows for the possibility of using the device solely with a high flow rate for more viscous products and/or products containing pieces, for example pieces of fruits or vegetables.

The flow regulation system can also be used to adapt the filling device to different products, in particular products with different viscosities, as the rod can adopt multiples intermediate positions deployed between its high flow-rate position and its low flow-rate position. The passage cross section of the feed duct shall be adapted to the viscosity of the product to be dosed by inserting the rod more or less into its internal passage.

According to an embodiment, said feed duct comprises

- an intermediate portion defining an intermediate central passage, more preferably substantially straight,
- an upstream portion, intended to be connected to dispensing means, defining an upstream passage for example substantially straight and a downstream portion connected to the feed orifice, defining a downstream passage for example substantially straight, as the flow-regulating rod is mounted in a sliding manner in an axial hole formed at an axial end of the intermediate portion of the feed duct, said second actuating system able to axially move the flow-regulating rod in the intermediate central passage, said axial hole opening into a first portion of the central passage, one among the downstream passage or the upstream passage opening laterally into said first portion of the intermediate passage, the other opening into a second portion of the passage.

According to an embodiment, said feed duct comprises said intermediate portion arranged substantially vertically, said upstream passage opening laterally into a first portion referred to as upper of the central passage of said intermediate portion, and the downstream passage opening into a second portion referred to as lower of the central passage, the flow-regulating rod being mounted in a sliding manner substantially vertically in the axial hole arranged at the upper end of the intermediate portion of the feed duct and opening into the upper portion.

According to an embodiment, the flow-regulating rod is substantially cylindrical.

According to an embodiment, the central passage comprises from its axial end provided with said axial hole, a first portion more preferably substantially cylindrical, of which the transverse cross section is greater than the transverse cross section of the flow-regulating rod, a portion referred to as intermediate and a second portion, said second portion having a section less than that of the first portion, the flow-regulating rod in its low flow-rate position extending into said intermediate portion and possibly into the second portion.

According to an embodiment, said first portion is substantially cylindrical, said intermediate portion is substantially tapered, with its section decreasing in the direction of the second portion. Such a tapered portion allows for a progressive variation of the passage cross section between the high flow-rate position and the low flow-rate position.

According to an embodiment, the intermediate passage comprises, from upstream to downstream in relation to the direction of flow of the filling product, in particular from bottom to top in the case of a substantially vertical disposition, the first substantially cylindrical upper portion, the tapered intermediate portion, and the second lower portion.

According to an embodiment, the internal surface of the intermediate portion that defines said intermediate central passage, is provided with a longitudinal recess extending along the intermediate portion and the second portion, said recess defining a secondary lateral passage for the flow of the filling product in low flow-rate position. The secondary passage opens directly onto the intermediate passage, as such limiting the possible blocking of pieces of the filling product. More preferably, the secondary passage is arranged in relation to the axis of the central passage on the same side as the upstream passage.

According to an embodiment, the transverse cross section of the upper portion of the intermediate central passage is greater than the transverse cross section of the upstream passage of the upstream portion. The feed duct as such has point load losses per divergent section then convergent section allowing for cross sections of substantial passage, and as such the dosing of viscous filling products and/or products with pieces of substantial size, and this in relation to a conventional nozzle first comprising the convergent section then the divergent section.

According to an embodiment, the upstream passage and the downstream passage open laterally into the lower portion of the intermediate central passage. The feed duct as such has point load losses of the elbow type, allowing for cross sections of substantial passage, and as such the dosing of a viscous filling product and/or product with pieces of substantial size.

According to an embodiment, the device comprises a single-piece part constituting at least one portion of the tubular body of the spout, the downstream portion of the feed duct, and more preferably at least one portion of the intermediate portion of the feed duct, whereon is mounted the flow-regulating rod, in such a way as to best control the positioning of the various elements of the device in relation to one another, and as such reduce its encumbrance, and to obtain a device that requires less seals and therefore a more hygienic device.

According to another embodiment, in low flow-rate position, the flow-regulating rod splits the internal passage of the feed duct into two substantially identical secondary passages, located symmetrically on either side of the flow-regulating rod. The creation of two symmetrical secondary passages on either side of the rod makes it possible to render uniform the rate of flow in the feed duct downstream of the flow-regulating rod. In the low flow-rate position, the free end of the flow-regulating rod is advantageously in the immediate vicinity of the internal surface of the passage of the feed duct, more preferably almost in contact, with a low clearance between the free end and said internal surface. The speed of movement of the rod between its two positions can be controlled by a control system in order to have a progressive movement between the two positions.

According to a particularity, the dosing means include a control system able to control the first actuating system and the second actuating system in order to maintain the flow-regulating rod in low flow-rate position when the valve is moved into open position at the start of dosing, in order to move the flow-regulating rod into retracted position during dosing, and in order to move the flow-regulating rod into low flow-rate position at the end of dosing, before the displacement of the valve into closed position.

According to an embodiment, the feed duct has an internal passage with a substantially circular section, the flow-regulating rod is mounted in a sliding manner on the feed duct substantially perpendicularly to the longitudinal axis of the internal passage of the duct, said second actuating system is able to move the flow-regulating rod radially in the internal passage of the duct, substantially perpendicularly to the direction of flow of the filling product.

According to an embodiment, the flow-regulating rod is cylindrical, with a circular transverse cross section less than that of the internal passage. The cylindrical surface of the flow-regulating rod also limits turbulences.

According to an embodiment, the flow-regulating rod has a free end with a convex surface, of which the radius of curvature corresponds to that of the internal surface of the internal passage of the feed duct.

According to an embodiment, the feed orifice is formed laterally in the tubular body.

According to an embodiment, said second control system comprises a cylinder comprising a cylinder rod able to be connected to the flow-regulating rod, for example via a cylinder rod tip, the cylinder body is mounted on the feed duct and carried by the latter, said cylinder body is mounted at a distance from the feed duct via possibly a plate and via at least one rigid linking arm extending in parallel and next to the flow-regulating rod, the cylinder rod and the possible cylinder rod tip.

According to an embodiment, said tubular body has an open upper axial end, said valve is assembled to the first end of a valve rod, said first control system comprises a cylinder comprising a cylinder rod able to be connected to the second end of the valve rod for example via a cylinder rod tip, through said open upper end, the cylinder body is mounted on the body of the spout and carried directly by the latter, said cylinder body is mounted above and at a distance from the body of the spout via possibly a plate and via at least one rigid linking arm extending in parallel and next to the valve rod, the cylinder rod, and the possible cylinder rod tip. Assembling actuating systems directly on the feed duct and the spout makes it possible to propose a filling device in the form of a module, which can be mounted directly via its feed duct to a filling tank. According to another embodiment, the control system of the valve is of the magnetic type.

According to an embodiment, the flow-regulating rod is able to be mounted in a removable manner to the free end of the cylinder rod by means of a rapid-connect coupling system comprising a member for blocking, and/or the second end of the valve rod is able to be mounted in a removable manner to the free end of the cylinder rod by means of a rapid-connect coupling system comprising a member for blocking. The flow-regulating rod can as such be easily removed in order to make it possible to replace the seal quickly.

According to an embodiment, for the assembling of the flow-regulating rod to the cylinder rod, a first element among the flow-regulating rod and the cylinder rod is able to be inserted into a tip or bridging sleeve mounted at the end of the other element, referred to as second element, the tubular wall of the bushing comprising at least one slot arranged perpendicularly to the axis of the flow-regulating rod, the member for blocking of the second coupling system is able to be inserted substantially perpendicularly to the axis of the flow-regulating rod in said slot and to engage with at least one exterior shoulder of the first element, in order to block the first element in the bushing in longitudinal translation. For the assembling of the valve rod to the cylinder rod, a first element among the valve rod and the cylinder rod is advantageously able to be inserted into a tip or bridging sleeve mounted at the end of the other element, referred to as second element, the tubular wall of the bushing comprising at least one slot arranged perpendicularly at the axis of the spout, the member for blocking of the second coupling system is able to be inserted substantially perpendicularly to the axis of the spout into said slot and to engage with at least one exterior shoulder of the first element, in order to block the first element in the bushing in longitudinal translation.

This invention also has for object a machine for filling containers comprising dispensing means filling liquid and several filling devices connected to said dispensing means, characterised in that each filling device is such as defined previously, with the feed ducts connected and fixed rigidly by their second end to said dispensing means. According to an embodiment, the machine is of the rotary type, and comprises a support structure mounted rotatingly on a fixed frame, and carrying said dispensing means, said dispensing means comprising a central tank, said feed ducts extending radially towards the exterior, at regular angular intervals, from the lower portion of the tank to which they are fixed, and carrying the filling spouts at the end.

BRIEF DESCRIPTION OF THE DRAWINGS

The invention shall be better understood, and other details, characteristics and advantages shall appear more clearly when reading the following detailed explanatory description of two particularly currently preferred embodiments of the invention, in reference to the annexed diagrammatical drawings, wherein.

DETAILED DESCRIPTION OF THE PREFERRED EMBODIMENT(S)

FIGS. 1 to 6 show a filling device according to a first embodiment of the invention, intended to be provided for a machine for filling, for example of the rotary type, comprising a carrousel comprising a support structure mounted rotating about a fixed frame around a vertical axis of rotation. The support structure carries dispensing means filling liquid, formed for example of a cylindrical central tank, and a plurality of filling devices according to the invention, located at regular angular intervals around the axis of rotation.

The filling device can be used for liquid filling products, such as water, milk, fruit juices or detergents, whether or not comprising pulps, to semi-liquids, such as drinkable yoghurt, sauces, vegetable oil or washing powder. The device shown in the figures is in particular intended to be used for the dosing of milk.

Figure 1:
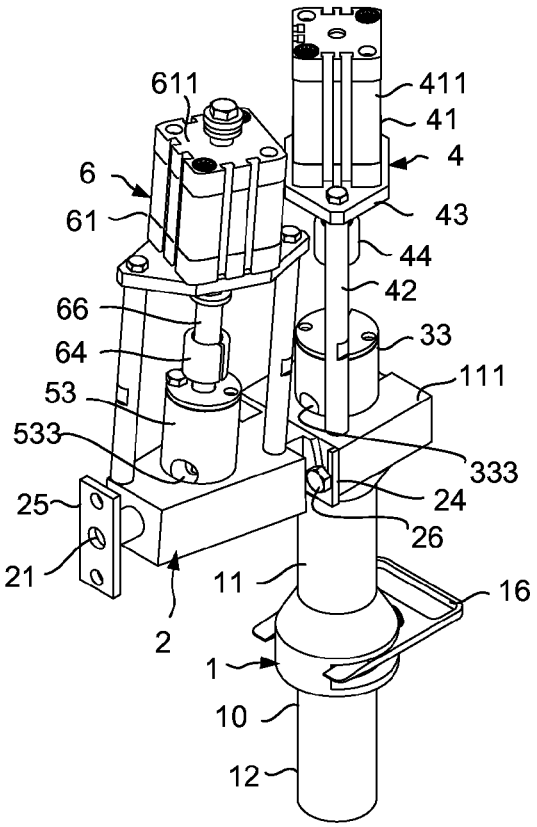
FIG. 1 is a perspective view of a filling device according to a first embodiment of the invention.
Figure 2:
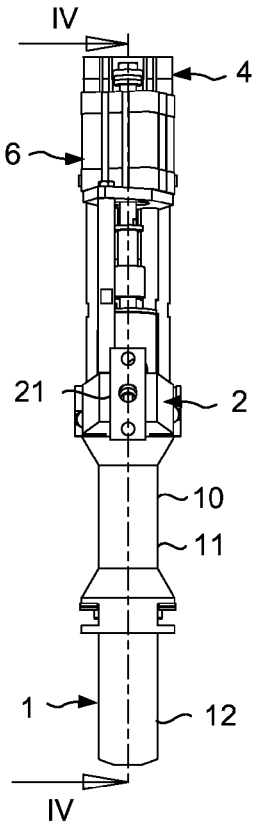
FIGS. 2 and 3 are two side views of the filling device of FIG. 1.
Figure 3:
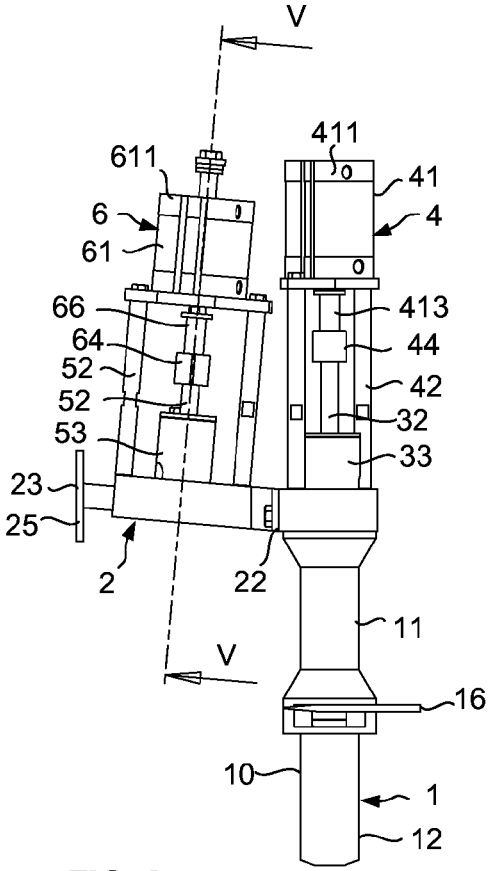
Figure 4:
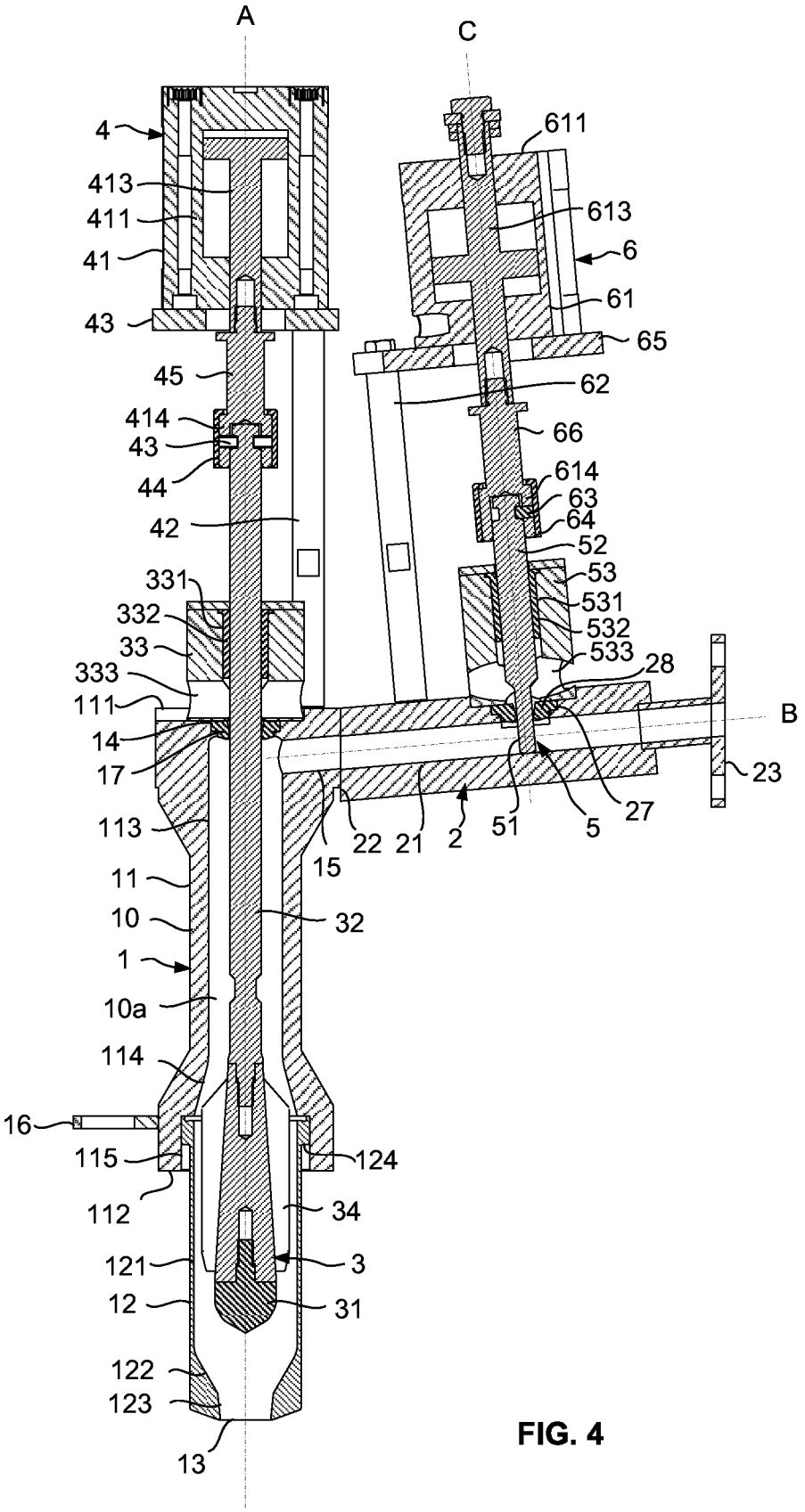
FIG. 4 is an enlarged cross-section view according to the plane IV-IV, with the valve in open position, and the flow-regulating rod in low flow-rate position.

In reference in particular to FIGS. 1 and 4, the filling device comprises a filling spout 1 with an outlet orifice 13 and a lateral feed orifice 15, a feed duct 2 connected to the feed orifice 15 for supplying the spout with filling product, and dosing means in order to deliver a determined quantity of filling product into each container brought under the spout.

The spout 1, with longitudinal axis A, is formed by a globally tubular body 10 having an internal passage 10*a*, an open upper axial end 14 and an open lower axial end constituting the outlet orifice 13. The longitudinal axis A of the spout is arranged substantially vertically.

The feed duct 2, formed by a rigid tube, has a tubular internal passage 21, substantially straight, with longitudinal axis B, of substantially constant circular section. It is rigidly connected by a first end 22 to the feed orifice. The filling device is intended to be connected by the second end 23 of the feed duct to the tank of the machine for filling. In this embodiment, the axis B of the internal passage 21 is slightly inclined in relation to the horizontal, for example by approximately 5°, in order to prevent the product from stagnating in the duct between the filling cycles. The duct is provided at each end with a flange 24, 25, for its assembly by means of two screws 26, on the one hand to the spout, on the feed orifice 15, and on the other hand to the tank of the machine for filling. The axis B of the passage 21 is aligned according the axis of the lateral feed orifice 15, the latter having a section that is substantially identical to that of the passage 21.

The tubular body 10 is comprised of two parts: an upper part 11, also called a metering device body, provided with the upper axial end 14 and with the feed orifice 15; and a lower part 12, also called a nozzle, provided with the outlet orifice 13, which is mounted in a removable manner on the upper part by means of a member for blocking formed by a generally U-shaped bracket 16, such as described in French patent application no. 0904645, filed on 29 Sep. 2009, in the name of the applying Company.

The internal surface of the wall of the upper part 11, which defines its internal passage, has from its upper edge 111 to its lower edge 112, an upper cylindrical section 113, a tapered section 114 increasing progressively downwards, and a lower cylindrical section 115, the tapered section and the lower section being connected by an interior shoulder directed towards the lower edge. The wall of the lower part 12 has a cylindrical exterior surface. Its internal surface, which defines its internal passage, has, from its upper edge to its outlet orifice 13, an upper cylindrical section 121, a tapered section 122 that reduces progressively downwards and forming a valve seat, and a lower cylindrical or tapered section 123 delimited by the outlet orifice. The lower part 12 is inserted into the lower section 115 of the upper part, until its upper edge is pressing against the shoulder, said upper edge being advantageously provided with a seal. The blocking of the two parts 11, 12 is carried out by inserting the two branches of the bracket 16 into the slots of the upper part 11 which are situated diametrically opposite on the upper part 11 and under the shoulder 124 of the lower part 12.

The dosing means include a blocking system 3 comprising a valve 31 arranged in the spout. This valve is controlled in opening and in closing by a first actuating system 4 comprising a cylinder 41 or actuator, for example pneumatic. The valve is mounted at a first end of a valve rod 32 which is mounted in a sliding manner in a sealed manner through the open upper axial end 14, via a guide block 33 in translation which is fixed on the upper edge 111 by means of screws (cannot be seen). The guide block has an axial passage 331 provided with a guiding ring 332 wherein passes the valve rod 32. The open upper axial end 14 is provided with an annular seal 17, maintained in place by the guide block. The guide block is provided with a transverse hole 333, passing through the block on either side and forming a leakage chamber, which makes it possible to locate possible leaks on the seal, and which makes it possible if necessary to clean the rear of said seal 17. The second end of the valve rod 32 is arranged above the guide block 33. The body 411 of the cylinder is mounted on the upper part 11 by means of two support rods 42 diametrically opposite and a plate 43. The support rods 42 are fixed on one side to the upper edge 111 of the upper part and on the other side to a plate 43 whereon is fixed the cylinder body 411 by means of two screws not shown. The cylinder rod tip 45 extending the cylinder rod 413 is centred according to the axis A and extends downwards between the two support rods, and its free end is mounted to the second end of the valve rod 32. For this assembly, the valve rod is inserted into the cylindrical lower portion 414 of the cylinder rod tip 45. A member for blocking formed by an annular half ring is inserted into a slot of the cylinder rod tip and engages with an exterior shoulder of the valve rod in order to block the valve rod in the cylinder rod tip in longitudinal translation. A sleeve 44 mounted slidingly on the cylinder rod tip can advantageously be moved from a high position, wherein it is arranged above the slot of the rod tip 45, to a low position, wherein it maintains the half ring in inserted position.

The cylinder 41 is able to move the valve 31 in vertical translation in the internal passage of the lower part between a closed position, wherein the valve cooperates with the tapered section 122 of the lower part in order to close the outlet orifice 13, and an open position shown in FIG. 4, in order to open the outlet orifice.

The cylinder rod is provided with flow stabilising fins 34 which, in the open position of the valve, extend into the tapered section 114 of the passage of the first part and into the cylindrical section 121 of the lower part.

Figure 5:
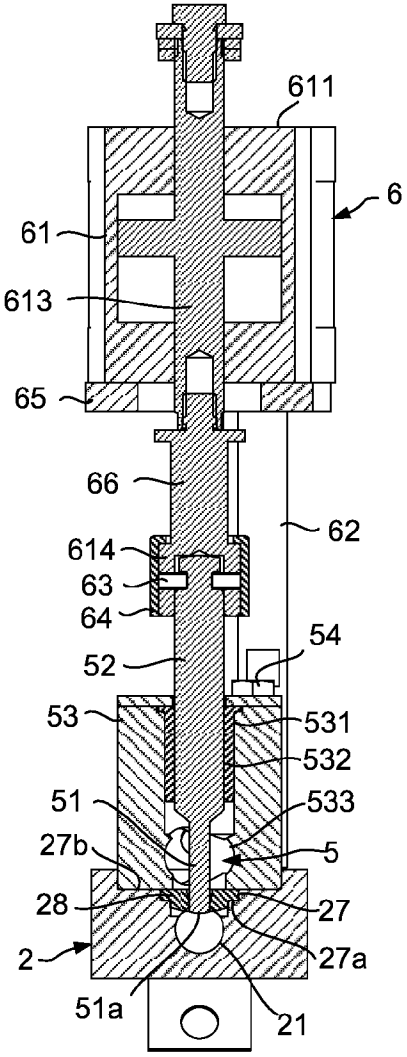
FIG. 5 is an enlarged view according to the section plane V-V of FIG. 3, with the flow-regulating rod in high flow-rate position.

The dosing means further include a flow regulation system 5 mounted on the feed duct 2. In reference to FIGS. 4, 5 and 6, this regulation system comprises a flow-regulating rod 51, of circular transverse cross section, with longitudinal axis C, mounted in a sliding manner radially, in a sealed manner, in an axial hole 27 of the feed duct which opens onto the internal passage 21. The circular transverse cross section of the flow-regulating rod 51 is less than the circular transverse cross section of the internal passage 21 of the feed duct. The rod 51 has a free end 51*a* with a convex surface, of which the radius of curvature substantially corresponds to that of the internal surface of the passage of the duct. The rod 51 has a cylindrical base 52, with a wider circular section, which is mounted in a sliding manner in a guide block in translation 53, fixed on the duct by means of screws 54 (FIG. 5). The guide block has an axial passage 531 provided with a guiding ring 532 wherein the base 52 passes. The seal is provided by means of an annular seal 28, for example made of elastomeric material. The hole 27 has a shoulder 27*a* directed towards the exterior. The seal 28 is provided with a collar. The seal is housed in the hole and is maintained in place by the guide block 53, with its collar thrust against said shoulder. The duct has for example a counter-bore 27*b* wherein the guide block is positioned. The guide block is provided with a transverse hole 533, passing through the block on either side and forming a leakage chamber, which makes it possible to locate any leaks on the seal, and which if necessary allows for the cleaning of the rear of said seal 28.

A second actuating system 6 makes it possible to move the flow-regulating rod 51 between a retracted position, referred to as high flow-rate and an extreme deployed position, referred to as low flow-rate. This second actuating system 6 comprises a cylinder 61, for example pneumatic. The body 611 of the cylinder is mounted on the duct 2 by means of two support rods 62 diametrically opposite and a plate 65. The support rods 62 are fixed on one side to the exterior surface of the feed duct 2 and on the other side to a plate 65 whereon is fixed the cylinder body 611 by the intermediary of two screws not shown. The cylinder rod tip 66 extending the cylinder rod 613 is centred according to the axis C, and extends downwards between the two support rods. Its free end is assembled at the end of the base 52, arranged above the guide block 53.

For this assembly, the base is inserted into the cylindrical lower portion 614 of the cylinder rod tip 66 mounted at the end of the cylinder rod 613. A member for blocking formed by an annular half ring 63 is inserted into a slot of the cylinder rod tip and engages with an exterior shoulder of the base 52 in order to block the base in the cylinder rod tip in longitudinal translation. A sleeve 64 mounted slidingly on the cylinder rod can be moved from a high position, wherein it is arranged above the slot of the cylinder rod tip 66, to a low position, wherein it maintains the half ring in inserted position.

Figure 6:
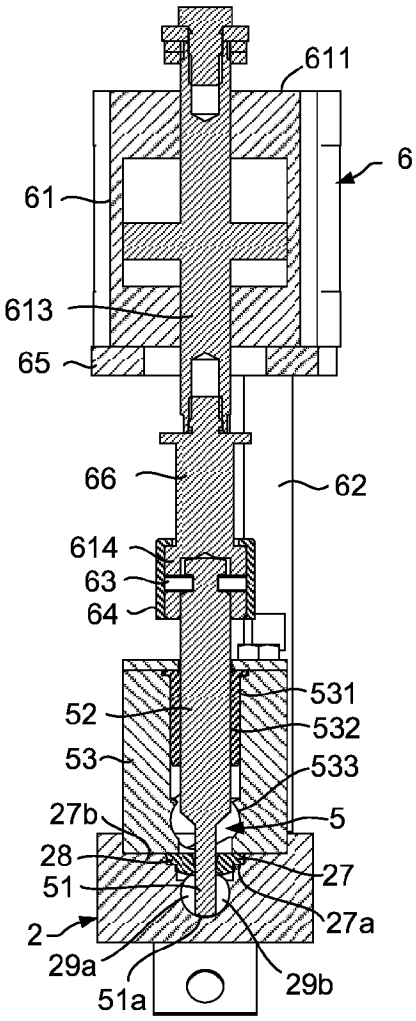
FIG. 6 is a view analogous to that of FIG. 5, with the flow-regulating rod in low flow-rate position.

The cylinder 61 is able to move the flow-regulating rod radially in the internal passage 21 between the high flow-rate position, shown in FIG. 5, and a low flow-rate position shown in FIGS. 4 and 6. In the high flow-rate position, the rod is arranged substantially outside the internal passage 21. Its free end 51*a* is arranged substantially on the lower surface of the seal 28. The passage cross section of the feed duct is at a maximum.

In the low flow-rate position, the rod 51 extends into said internal passage 21, it-s free end 51*a* is located in the immediate vicinity of the internal surface of the passage, opposite the hole 27. The free end 51*a* can be in contact with the surface. More preferably, the rod is not in contact with the internal surface, as a clearance is maintained between the rod and the internal surface of the passage, for example of half a millimeter, in order to prevent clogging this surface. The rod in low flow-rate position forms two identical secondary passages 29*a*, 29*b* (FIG. 6), located symmetrically on either side of the rod 51.

According to the penetration of the rod 51 into the duct 21 or the diameter of the rod 51, the passage cross section can be reduced by 30 to 70% in order to obtain the low flow-rate that is best suited for the product/container pair. For the preferred embodiment, the flow-regulating rod has a diameter of 6 mm, with the diameter of the internal passage at 12.6 mm. The passage cross section is as such approximately 125 mm2, and is reduced in low flow-rate position to approximately 50 mm2 with two secondary passages of approximately 25 mm2, which is a reduction in the passage cross section of approximately 60%.

The dosing means include a control system (not shown) making it possible to control the cylinders 41, 61. The dosing means are for example of the weight-based type, with the cylinders controlled by a weighing sensor of the control system, which is placed for example on a container support device associated with the filling device. Alternatively, the cylinders are controlled by a container filling level detection sensor or a flow-rate sensor that is inserted between the container and the spout at the time of filling, or a volumetric system.

The operation of the filling device according to the invention for the filling of a container is as follows.

With the regulating rod 51 in low flow-rate position, the control system controls the cylinder 41 in order to move the valve 31 into its open position as shown in FIG. 4. The flow of filling product passes on either side of the rod, via the two secondary passages. The flow then passes in the tubular internal passage 21 then opens into the cylindrical section 113 of the upper part 11, wherein extends the valve rod 32 with substantially constant section. This cylindrical section 113 has a substantially constant passage cross section and a substantial length making it possible to stabilise the flow. The fins 34 are used to stabilise the flow by channelling the lines of current, which has for effect to render the flow more laminar.

The control system then controls the cylinder 61 in order to move the regulating rod 51 from its low flow-rate position, shown in FIGS. 4 and 6 to its high flow-rate position shown in FIG. 5. At the end of dosing, the control system controls the cylinder 61 in order to move the regulating rod 51 to its low flow-rate position, then controls the cylinder 41 to move the valve 31 to its closed position.

The speed of movement of the cylinder of the flow-regulating rod is advantageously less than that of the valve cylinder. To do this, the diameter of the piston of the cylinder of the flow-regulating rod is for example greater than that of the piston of the valve cylinder.

FIGS. 7 to 13 show a filling device according to a second embodiment of the invention.

Figure 7:
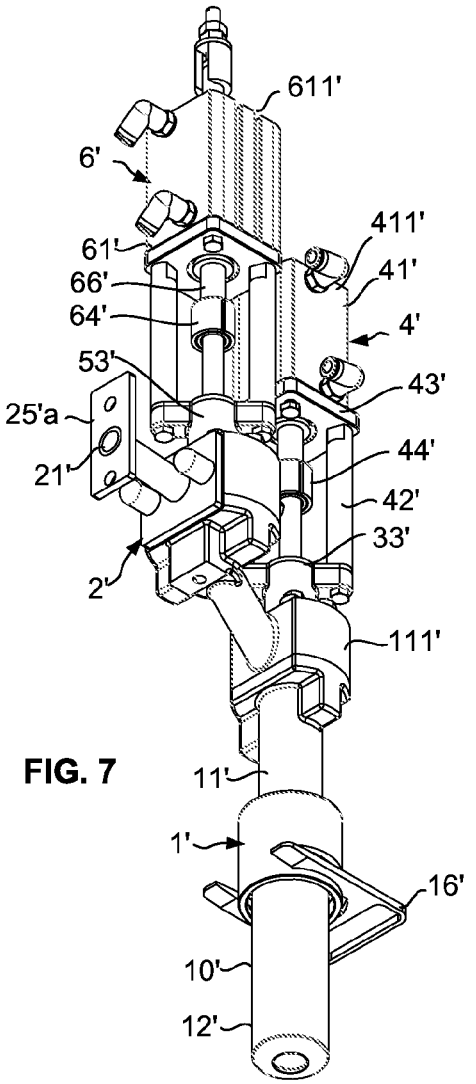
FIG. 7 is a perspective view of a filling device according to a second embodiment of the invention.
Figure 8:
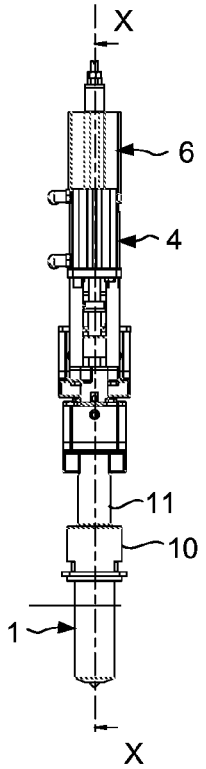
FIG. 8 is a front view of the filling device of FIG. 7.
Figure 10:
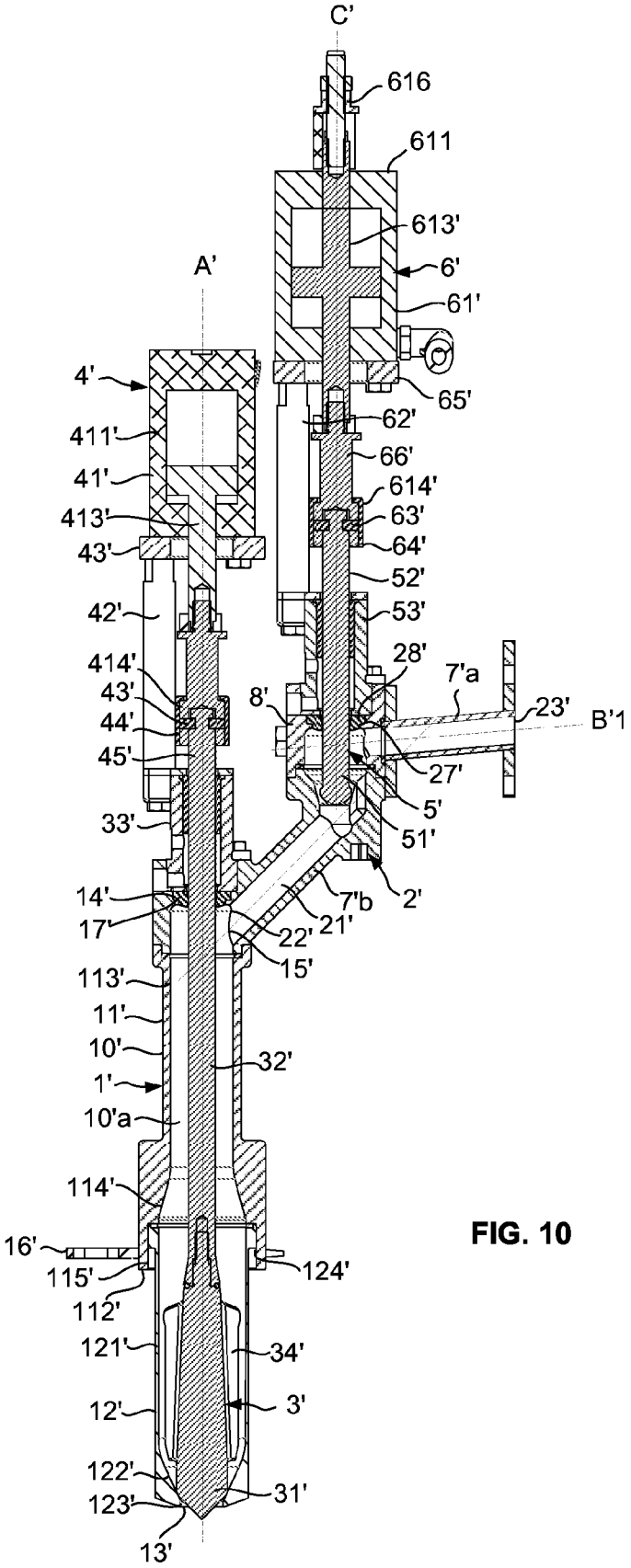
FIG. 10 is an enlarged cross-section view according to the plane X-X, of FIG. 8, with the valve in closed position, and with the flow-regulating rod in low flow-rate position.

In reference in particular to FIGS. 7 and 10, the filling device comprises a filling spout 1' with an outlet orifice 13' and a lateral feed orifice 15', a feed duct 2' connected to the feed orifice 15' for supplying the spout with filling product, and dosing means in order to deliver a determined quantity of filling product into each container brought under the spout.

The spout 1', with longitudinal axis A', is formed by a globally tubular body 10' having an internal passage 10'*a*, an open upper axial end 14' and an open lower axial end constituting the outlet orifice 13'. The longitudinal axis A' of the spout is arranged substantially vertically.

The feed duct 2' has an internal passage 21' and is connected by a first end 22' to the feed orifice. The filling device is intended to be connected by the second end 23' of the feed duct to the tank of the machine for filling.

The tubular body 10' comprises an upper part 11', also called a metering device body, provided with the upper axial end 14' and the feed orifice 15'; and a lower part 12', also called a nozzle, provided with the outlet orifice 13', which is mounted in a removable manner on the upper part by means of a member for blocking formed by a generally U-shaped bracket 16'.

The internal surface of the wall of the upper part 11', which defines its internal passage, has from its upper edge 111' to its lower edge 112', an upper cylindrical section 113', a tapered section 114' progressively increasing downwards, and a lower cylindrical section 115', the tapered section and the lower section being connected by an interior shoulder directed towards the lower edge. The wall of the lower part 12' has a cylindrical exterior surface. Its internal surface, which defines its internal passage, has, from its upper edge to its outlet orifice 13', an upper cylindrical section 121', a tapered section 122' progressively reducing downwards and forming a valve seat, and a lower cylindrical or tapered section 123' delimited by the outlet orifice. The lower part 12' is inserted into the lower section 115' of the upper part, until its upper edge is pressing against the shoulder, said upper edge being advantageously provided with a seal. The blocking of the two parts 11', 12' is carried out by inserting the two branches of the bracket 16' into the slots of the upper part which are diametrically opposite on the upper part 11' and under the shoulder 124' of the lower part 12'.

Figure 11:
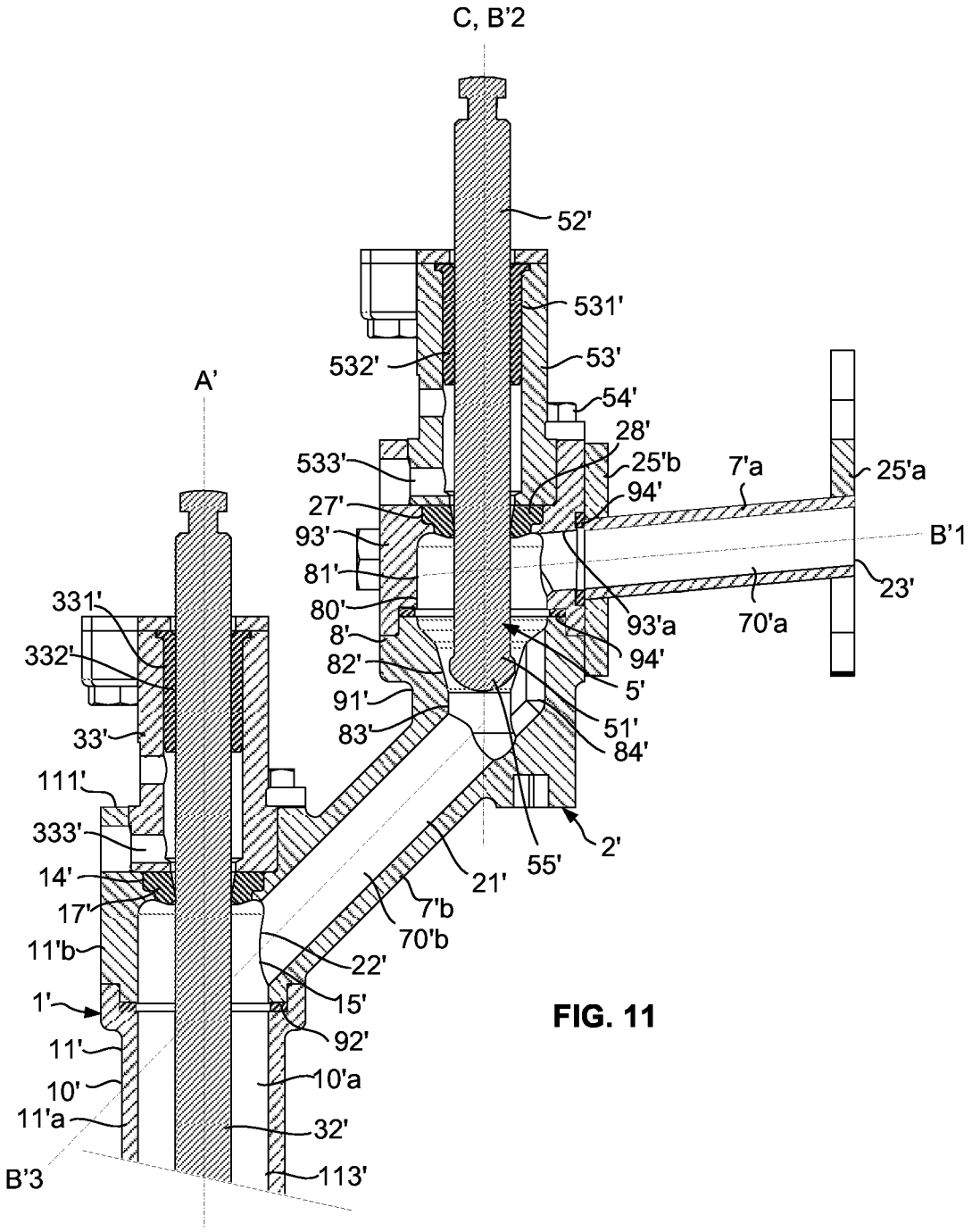
FIG. 11 is a partial enlarged view of FIG. 10.

In reference to FIGS. 10 and 11, the dosing means include a blocking system 3' comprising a valve 31' arranged in the spout. This valve is controlled in terms of opening and closing by a first actuating system 4' comprising a cylinder 41', for example pneumatic. The valve is mounted at a first end of a valve rod 32' which is mounted in a sliding manner in a sealed manner through the open upper axial end 14', via a guide block 33' in translation 33' which is fixed on the upper edge 111' by means of screws. The guide block has an axial passage 331' provided with a guiding ring 332' wherein passes the valve rod 32'. The open upper axial end 14' is provided with an annular seal 17', maintained in place by the guide block. The guide block is provided with a transverse hole 333', forming a leakage chamber, which makes it possible to locate any leaks on the seal, and which makes it possible if necessary to clean the rear of said seal 17'. The second end of the valve rod 32' is arranged above the guide block 33'. The body 411' of the cylinder is mounted on the upper part 11' by means of two support rods 42' diametrically opposite and a plate 43. The support rods 42' are fixed on one side to lateral lugs of the guide block, and on the other side to a plate 43' whereon is fixed the cylinder body 411' for example by means of two screws. The cylinder rod tip 45' extending the cylinder rod 413' is centred according to the axis A' and extends downwards between the two support rods, and its free end is mounted to the second end of the valve rod 32'. For this assembly, the valve rod is inserted into the interior cylindrical portion 414' of the cylinder rod tip 45'. A member for blocking formed by an annular half ring is inserted into a slot of the cylinder rod tip and engages with an exterior shoulder of the valve rod in order to block the valve rod in the cylinder rod tip in longitudinal translation. A sleeve 44' mounted slidingly on the cylinder rod tip can advantageously be moved from a high position, wherein it is arranged above the slot of the rod tip 45', to a low position, wherein it maintains the half ring in inserted position.

Figure 12:
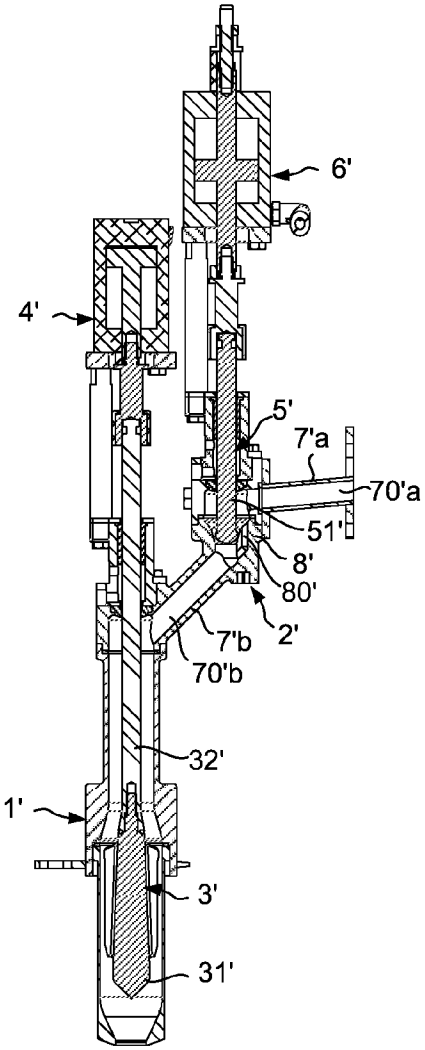
FIG. 12 is a view analogous to that of FIG. 10, with the valve in open position, and with the flow-regulating rod in low flow-rate position.

The cylinder 41' is able to move the valve 31' in vertical translation in the internal passage of the lower part between a closed position, such as is shown in FIG. 10, wherein the valve cooperates with the tapered section 122' of the lower part in order to close the outlet orifice 13', and an open position shown in FIG. 12, in order to open the outlet orifice.

The cylinder rod is provided with flow stabilising fins 34' which, in the open position of the valve, extend into the tapered section 114' of the passage of the first part and into the cylindrical section 121' of the lower part.

The dosing means further include a flow regulation system 5' mounted on the feed duct 2'.

In reference to FIGS. 10 and 11, the feed duct 2' comprises from upstream to downstream in relation to the direction of flow of the filling product;

- an upstream portion 7'*a*, having a tubular internal upstream passage 70'*a*, substantially straight, with longitudinal axis B'1, with a substantially constant circular section, comprising the second end 23' of the feed duct;
- an intermediate portion 8' having an intermediate central passage 80' of a globally cylindrical shape, with a vertical longitudinal axis B'2; and,
- and a downstream portion 7'*b* having a tubular downstream passage 70'*b*, substantially straight, with longitudinal axis B'3, with substantially constant circular section, substantially equal to that of the downstream passage 70'*a*, said downstream portion comprising the first end 22' connected to the feed orifice 15'.

The intermediate central passage 80' comprises, from top to bottom, a globally cylindrical upper portion 81', with a transverse cross section greater than that of the downstream passage 70'*b*, a tapered intermediate portion 82', of which the section decreases from bottom to top, and a substantially cylindrical lower portion 83'.

The upstream passage 70'*a* opens laterally into the upper portion 81' of the intermediate central passage. Its axis B'1 is slightly inclined in relation to the horizontal, for example by approximately 5°, in order to prevent the product from stagnating in this upstream portion between the filling cycles.

The downstream passage 70'*b* opens laterally into the lower portion 83' of the central passage, opposite the upstream passage 70'*a* in relation to the axis B'2. Its axis B'3 is for example arranged approximately at 45° in relation to the horizontal. Alternatively, the axis B'3 is arranged at approximately 90° from the axis B'2, more preferably with a slight angle in relation to the horizontal in order to prevent any stagnation of the product.

The internal surface forming the central passage of axis B'2, has a longitudinal recess of globally semi-circular transverse cross section extending along the tapered portion and the lower portion, said recess forming a secondary lateral passage 84'.

The secondary lateral passage is arranged substantially in the same plane as the axes B'1 and B'2 and B'3, and is arranged in relation to the axis B'2 on the same side as the axis B'1.

The regulation system comprises a flow-regulating rod 51', with circular transverse cross section, with a substantially vertical longitudinal axis C', mounted in a sliding manner axially, in a sealed manner, in an axial hole 27' of the feed duct, formed at the upper end of its intermediate portion, with the hole opening onto the upper portion 81' of the central passage. The circular transverse cross section of the rod 51' is less than the transverse cross section of the upper portion 81'. The rod has a transverse cross section substantially equal to the section of the lower portion 83', more preferably slightly less. In this embodiment, the rod has an end portion 55' with a section that is slightly greater than the rest of the rod, the transverse cross section being substantially equal or slightly less than the section of the lower portion 83' on this end portion 55'.

The rod 51' is mounted in a sliding manner in a guide block 53' in translation, fixed on the upper edge of the intermediate portion 8' of the duct for example by means of screws 54'. The guide block has an axial passage 531' provided with a guiding ring 532' wherein the rod 51' passes. The seal is provided by means of an annular seal 28', for example made of elastomeric material. The hole 27' has a shoulder directed towards the exterior. The seal 28' is provided with a collar. The seal is housed in the hole and is maintained in place by the guide block 53', with its collar thrust against said shoulder. The duct has for example a bore wherein the guide block is positioned. The guide block is provided with a transverse hole 533', forming a leakage chamber, which makes it possible to locate possible leaks on the seal, and which makes it possible if necessary to clean the rear of said seal 28'.

A second actuating system 6' makes it possible to move the flow-regulating rod 51' between a retracted position, referred to as high flow-rate and an extreme deployed position, referred to as low flow-rate. This second actuating system 6' comprises a cylinder 61', for example pneumatic. The body 611' of the cylinder is mounted on the guide block by means of two support rods 62' diametrically opposite and a plate 65. The support rods 62 are fixed on one side to two lateral lugs of the guide block 53' and on the other side to a plate 65' whereon is fixed the cylinder body 611', for example by the intermediary of two screws. The cylinder rod tip 66' extending the cylinder rod 613 is centred according to the axis C', and extends downwards between the two support rods. Its free end is assembled to the portion 52' of the rod, arranged above the guide block 53'.

For this assembly, the rod is inserted into the cylindrical lower portion 614' of the cylinder rod tip 66' mounted at the end of the cylinder rod 613'. A member for blocking formed by an annular half ring 63' is inserted into a slot of the cylinder rod tip and engages with an exterior shoulder of the rod 51' in order to block the rod in the cylinder rod tip in longitudinal translation. A sleeve 64' mounted slidingly on the cylinder rod can be moved from a high position, wherein it is arranged above the slot of the cylinder rod tip 66', to a low position, wherein it maintains the half ring in inserted position.

Figure 13:
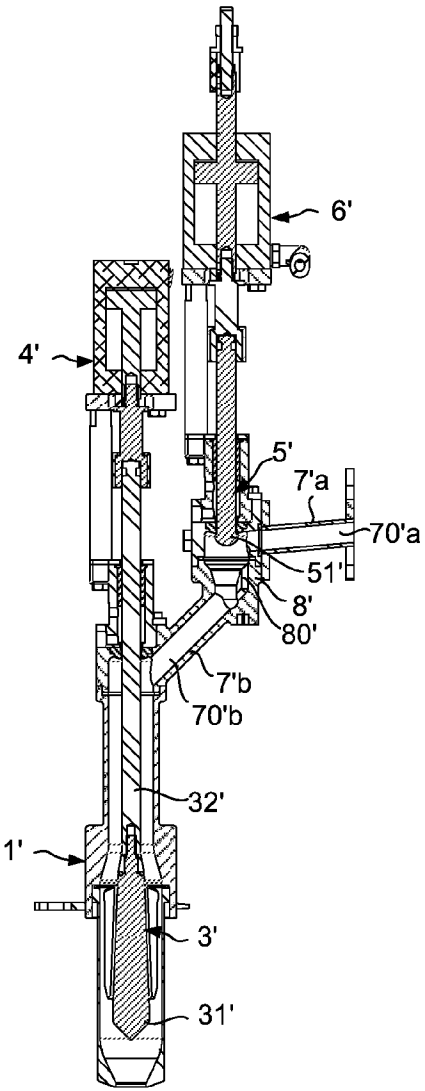
FIG. 13 is a view analogous to those of FIGS. 10 and 12, with the valve in open position, and with the flow-regulating rod in high flow-rate position.

The cylinder 61' is able to move in vertical translation the flow-regulating rod 51' axially in the central passage 80', between the high flow-rate position, shown in FIG. 13, and a low flow-rate position shown in FIGS. 10 to 12. In the high flow-rate position, the rod 51' is arranged substantially outside the internal passage 21, with only its end portion 55' arranged in the upper portion 81' of the central passage, under the lower surface of the seal 28'. The passage cross section of the feed duct is at a maximum.

In the low flow-rate position, the rod 51' extends into the upper portion 81' and into the tapered portion 82' of the central passage, with the end portion 55' being arranged in this tapered portion, above the lower portion 83'.

The dosing means include a control system (not shown) making it possible to control the cylinders 41', 61'. The dosing means are for example of the weight-based type, the cylinders being controlled by a weighing sensor of the control system, which is placed for example on a container support device associated with the filling device. Alternatively, the cylinders are controlled by a container filling level detection sensor or a flow-rate sensor inserted between the container and the spout at the time of filling, or a volumetric system.

The operation of the filling device according to the invention for the filling of a container is as follows.

With the regulating rod 51' in low flow-rate position, the control system controls the cylinder 41' in order to move the valve 31' into its open position as shown in FIG. 12. The flow of filling product coming from the upstream passage 70'*a* penetrates into the annular upper portion formed by the rod 51' positioned in the upper portion 81' of the central passage, then by the secondary lateral passage 84', as well as by the annular tapered passage formed by the end portion 55' of the rod positioned in the tapered portion 82'. The flow then passes into the lower portion 83' of the central passage, in the downstream passage 70'*b*, then into the cylindrical section 113' of the upper part 11', wherein extends the valve rod 32'. This cylindrical section 113' has a substantial length making it possible to stabilise the flow. The fins 34 are used to stabilise the flow by channelling the lines of current, which has for effect to render the flow more laminar.

The control system then controls the cylinder 61' in order to move the regulating rod 51' from its low flow-rate position, to its high flow-rate position, as shown in FIG. 13. At the end of dosing, the control system controls the cylinder 61' in order to move the regulating rod 51' to its low flow-rate position, then controls the cylinder 41' to move the valve 31' to its closed position as shown in FIG. 10.

The speed of movement of the cylinder of the flow-regulating rod is advantageously less than that of the valve cylinder. To do this, the diameter of the piston of the cylinder of the flow-regulating rod is for example greater than that of the piston of the valve cylinder.

In this embodiment, the flow-regulating rod moves vertically in the direction of flow of the product in order to pass from one position to the other. The secondary lateral passage opens directly into the central passage, which limits the risks of pieces blocking, with the pieces possible wedged in the secondary passage in low flow-rate position able to be evacuated when the flow-regulating rod is brought back to high flow-rate position.

The elbow between the upstream passage and the central passage, and the elbow between the central passage and the downstream passage create substantial point load losses.

Load losses are also created by the divergent section formed by the increase in the section between the upstream passage and the upper portion of the central passage, then by the convergent section formed by the decrease in section between this upper portion and the lower portion of the central passage and the downstream passage.

These point load losses of the elbow type, and these load losses by a nozzle system of the divergent section and then convergent section type make it possible to propose a feed duct with a substantial passage cross section which, contrary to conventional nozzle systems of the convergent section and then divergent section type, do not decrease, and as such dose viscous products and/or products with pieces of substantial size in high flow-rate position.

In low flow-rate position, the passage cross section is not split into two portions, as in the previous embodiment, which makes it possible to dose in low flow-rate filling products with marked items (pulps, herbs, etc.) or small pieces of a more substantial size.

In this embodiment, the nozzle body 11' of the spout is formed of two globally cylindrical portions, a cylindrical lower portion 11'*a* whereon is mounted the nozzle 12', and a cylindrical upper portion 11'*b* provided with the upper axial end 14' and the feed orifice 15'.

Figure 9B:
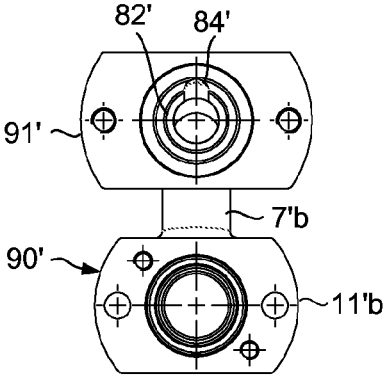
FIGS. 9*a* and 9*b* are respectively a top view and a perspective view of an element constituting the filling device of FIG. 7.
Figure 9A:
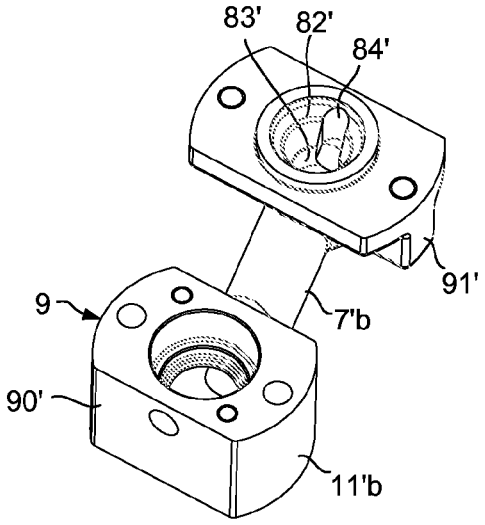

In reference to FIGS. 9*a*, and 9*b*, the device comprises a single-piece part 90' constituting said upper portion 11'*b* of the spout, the downstream portion 7'*b* of the feed duct and a tubular portion, referenced as 91', wherein are constituted the lower portion 83' and the tapered portion 82' of the central passage and the secondary lateral passage 84'. This part is assembled via its portion 11'*b* to the portion 11'*a* of the metering device body, for example by screwing, by inserting a seal 92'.

The rest of the intermediate portion of the duct is formed by a tubular part 93' constituting the upper portion 81' of the central passage, and provided with the axial hole 27' and a lateral hole 93'*a*. This tubular part 93' is assembled via its lower edge to the tubular portion 91', for example by screwing, by inserting a seal 94'.

This single-piece part 90' makes it possible to limit the number of seals and to guarantee a precise centre distance between the cylinder rod 32' and the flow-regulating rod 52' and as such optimise the encumbrance of the device.

In this embodiment, the device comprises identical guide blocks 33', 53' for the two actuating systems, as well as identical seals 17', 27' for the sliding assembly in a sealed manner of the cylinder rod 32' and of the flow-regulating rod 51'.

The upstream portion 7'*a* of the feed duct is formed of a rigid tube provided with each end of a flange 25'*a*, 25'*b*, for its assembly, on the one hand to the intermediate portion 8', on lateral hole 93'*a* of the part 93' that opens into the upper portion of the central passage, and on the other hand to the tank of the machine for filling. The axis B'1 of the upstream passage 70'*a* is aligned according the axis of the lateral hole 93'*a*, with the latter having a section that is substantially identical to that of the upstream passage.

The travel of the flow-regulating rod can be adjusted via a regulating system 616, for example with screws, in order to obtain the low flow-rate that is best suited for the filling product and the container.

Figure 14:
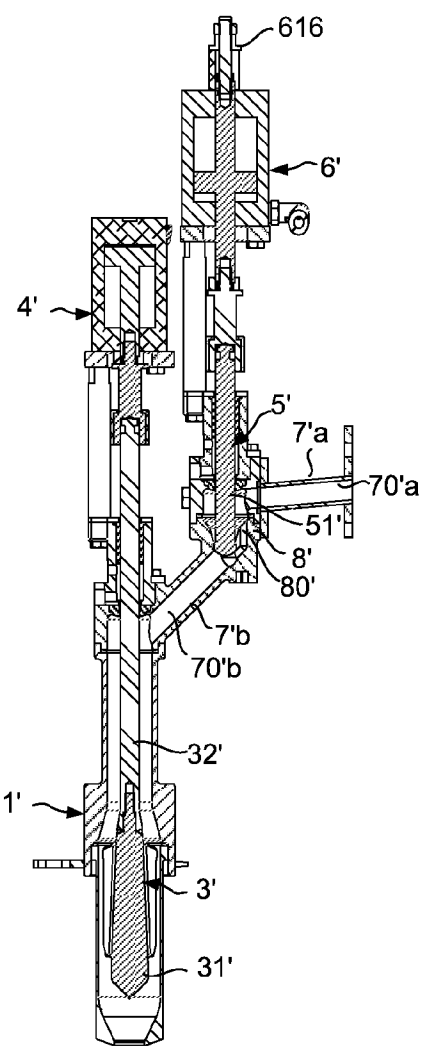
FIG. 14 is a view analogous to that of FIG. 12, with the flow-regulating rod in a different low flow-rate position.

In the example shown in FIG. 14, the travel of the rod 51' is adjusted in such a way that in low flow-rate, the end portion 55' of the rod is arranged beyond the tapered portion 82' of the central passage, on its lower portion 83'. In low flow-rate, the rod almost completely blocks the central passage, with the flow of filling product passing through the secondary lateral passage, arranged in parallel to the central passage, and with a reduced section in relation to the central passage.

Although the invention has been described in liaison with two particular embodiments, it is of course obvious that it is in no way restricted to this and that it includes all of the technical equivalent of the means described as well as combinations thereof if the latter fall within the scope of the invention.

The invention claimed is:

1. A filling device for a machine for filling comprising a filling spout formed by a tubular body having an internal passage with a longitudinal axis, an open lower axial end constituting an outlet orifice, and a feed orifice, a feed duct to supply said filling spout with filling product connected by a first end to the feed orifice, dosing means comprising a blocking system comprising a valve mounted mobile in said tubular body, a first actuating system able to longitudinally move said valve between a closed position in order to close the outlet orifice and at least one open position, and a flow regulation system mounted on the feed duct, wherein said flow regulation system comprises a flow-regulating rod, mounted in a sliding manner in a substantially sealed manner in a hole of said feed duct, said hole opening into an internal feed passage of said feed duct, and said hole being of a circular transverse section smaller than a circular transverse section of said internal passage, in order to allow a section of the internal passage to be reduced, and a second actuating system able to move the flow-regulating rod, between a retracted position, referred to as high flow-rate, wherein said rod is arranged substantially outside the internal feed passage of the feed duct, and a deployed position, referred to as low flow-rate, wherein said rod extends into said internal passage in order to reduce the circular transverse passage section of the feed duct; wherein said feed duct comprises an intermediate portion defining an intermediate central passage, an upstream portion defining an upstream passage and a downstream portion defining a downstream passage, and the flow-regulating rod being mounted in a sliding manner in an axial hole formed at an axial end of the intermediate portion of the feed duct, and said second actuating system able to move the flow-regulating rod axially in the intermediate central passage; wherein the intermediate central passage comprises from its axial end provided with said axial hole, a first portion having a transverse section greater than the transverse section of the flow-regulating rod, an intermediate portion and a second portion, said second portion having a transverse section less than that of the first portion, and the flow-regulating rod in its low flow-rate position extending into said intermediate portion and into the second portion; wherein the intermediate portion having an internal surface, which defines said intermediate central passage, is provided with a longitudinal recess extending along the intermediate portion and the second portion, and said recess defining a secondary lateral passage for the flow of the filling product in low flow-rate position.

2. The filling device according to claim 1, wherein said feed duct comprises said intermediate portion arranged substantially vertically, said upstream passage opening laterally into a first upper portion of the intermediate central passage of said intermediate portion, and the downstream passage opening into a second lower portion of the central passage, and the flow-regulating rod being mounted in a sliding manner substantially vertically in the axial hole arranged at the upper end of the intermediate portion of the feed duct.

3. The filling device according to claim 2, wherein a transverse section of the first portion of the intermediate central passage is greater than a transverse section of the upstream passage of the upstream portion.

4. The filling device according to claim 2, wherein the upstream passage opens laterally into the first upper portion of the intermediate central passage and the downstream passage opens laterally into the second portion of the intermediate central passage.

5. The filling device according to claim 2, wherein the filling device comprises a single-piece part constituting at least one portion of the tubular body of the spout, the downstream portion of the feed duct, and at least one portion of the intermediate portion of the feed duct.

6. The filling device according to claim 1, wherein the flow-regulating rod is substantially cylindrical.

7. The filling device according to claim 1, wherein an axis of the internal passage is inclined in relation to a horizontal axis and in that a longitudinal axis of the regulating rod is inclined in relation to a vertical axis.

8. The filling device according to claim 1, wherein said first portion is substantially cylindrical and said intermediate portion is substantially tapered.

9. The filling device according to claim 8, wherein the intermediate central passage comprises, from upstream to downstream in relation to direction of flow of the filling product, the first portion, the intermediate portion, and the second portion.

10. The filling device according to claim 1, wherein in the low flow-rate position, the flow-regulating rod splits the internal passage of the feed duct into two substantially identical secondary passages, located symmetrically on either side of the flow-regulating rod.

11. The filling device according to claim 10, wherein the feed duct has an internal passage of substantially circular section, the flow-regulating rod is mounted in a sliding manner substantially perpendicularly on the feed duct, and said second actuating system is able to move the flow-regulating rod radially in the internal passage of the duct.

12. The filling device according to claim 11, wherein the flow-regulating rod has a free end with a convex surface, of which the radius of curvature corresponds to that of the internal surface of the internal passage of the feed duct.

13. The filling device according to claim 1, wherein the feed orifice is formed laterally in the tubular body.

* * * * *